US005896151A

United States Patent [19]

Miyazawa et al.

[11] Patent Number: 5,896,151

[45] Date of Patent: *Apr. 20, 1999

[54] INK CARTRIDGE FOR AN INK JET PRINTER

[75] Inventors: Hisashi Miyazawa; Munehide Kanaya, both of Nagano, Japan

[73] Assignee: Seiko Epson Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/583,293

[22] Filed: Jan. 5, 1996

[30] Foreign Application Priority Data

Jan. 5, 1995 [JP] Japan ..... 7-015517

[51] Int. Cl.[6] ..... B41J 2/175

[52] U.S. Cl. ..... 347/86

[58] Field of Search ..... 347/86, 87

[56] References Cited

U.S. PATENT DOCUMENTS

| | | | |
|---|---|---|---|
| 4,119,034 | 10/1978 | Wax | 347/86 |
| 5,307,091 | 4/1994 | DeCoste, Jr. | 347/86 |
| 5,541,632 | 7/1996 | Khodapanah et al. | 347/87 |

FOREIGN PATENT DOCUMENTS

| | | |
|---|---|---|
| 59 194855 | 11/1984 | European Pat. Off. . |
| 59 204570 | 11/1984 | European Pat. Off. . |
| 63 281849 | 11/1988 | European Pat. Off. . |
| 03 222756 | 10/1991 | European Pat. Off. . |
| 03 295665 | 12/1991 | European Pat. Off. . |
| 0 562717 | 9/1992 | European Pat. Off. . |
| 05 016377 | 1/1993 | European Pat. Off. . |
| 56-067269 | 6/1981 | Japan . |
| 06-183023 | 7/1994 | Japan . |

*Primary Examiner*—Stuart N. Hecker

*Attorney, Agent, or Firm*—Stroock & Stroock & Lavan LLP

[57] ABSTRACT

An ink cartridge using an ink bag capable of being mounted in a carriage, comprising: a container having a body unit 1 and a cover unit 3 to form an internal space therebetween, at least one of said body unit and said cover unit being provided with valves 10 and 11 openable for communication between the internal space of said container and the atmosphere according to pressure change in said container; a cap 21 connecting with an ink supply needle of a recording head mounted in a carriage; and an ink bag, the periphery of which is held by said cover unit 3 and body unit 1. A constant negative pressure can be maintained by valves 10 and 11, and the periphery of ink bag 20 is held by body unit 1 and cover unit 3, ensuring as constant a shape as possible and preventing pressure changes caused by oscillation.

22 Claims, 4 Drawing Sheets

INK CARTRIDGE FOR AN INK JET PRINTER

BACKGROUND OF THE INVENTION

1. Field of the Invention

The present invention relates to an ink cartridge suitable for mounting on a carriage carrying an ink jet type recording head.

2. Related Art

An ink jet printer is constructed in such a way that an ink jet type recording head—wherein pressure is applied to pressure-generating chambers communicating with a common ink chamber and nozzle apertures, and ink is discharged from nozzle apertures—and an ink cartridge supplying ink to a recording head-are mounted on a carriage; and -ink drops matching printing data are discharged onto a recording sheet while the carriage is moved reciprocally.

Incidentally, because the nozzle apertures of the recording head are positioned in a location lower than the liquid level of the ink cartridge, and positive pressure acts on the nozzle apertures, normally a porous flexible member such as foam rubber is accommodated within the ink cartridge and it is constructed in such away that due to surface tension from the porous flexible member the pressure in the ink cartridge is a little lower than that in the nozzle apertures; and measures are taken to prevent ink bleeding from the nozzle apertures.

However, when ink consumption continues, the amount of ink absorbed in the porous flexible member becomes less and the capillary force of the porous flexible member becomes greater; the supply of ink to the recording head becomes easily delayed, the ink within the cartridge is not completely consumed and the actual volume of the porous flexible member only makes the ink cartridge larger because the amount of ink which can be accommodated in the cartridge becomes smaller.

In order to solve these kinds of problems, inventions have been considered utilizing ink accommodated in a bag member maintaining negative pressure by normal expansion force being supplied by a flexible member, wherein the bag member is mounted on a base with ink being supplied to a recording head through a tube as disclosed in Unexamined Japanese Patent Publications Nos. Sho. 56-67269, and Hei. 6-183023 etc. However, because members such as springs etc. for generating negative pressure are necessary, the size becomes larger, and also because changes in pressure occur caused by ink oscillation due to the movement of the carriage, and there is the problem that it is not suitable to mount them in the carriage.

SUMMARY OF THE INVENTION

As an invention to solve these types of problems, the object of the present invention is to provide a novel ink cartridge utilizing an ink bag which can be carried on a carriage.

In order to solve these kinds of problems, the present invention consists of an ink cartridge for ink supply to an ink jet recording head in an ink jet printer, comprising a container having a body unit and a cover unit to form an internal space therebetween, at least one of said body unit and said cover unit being provided with valves openable for communication between the internal space of said container and the atmosphere according to pressure change in said container; an ink bag, containing ink therein, said ink bag being mounted in the internal space of said container; and a connecting member provided in said container for allowing fluid communication between the ink in said ink bag and said ink jet recording head.

A constant negative pressure can be maintained by a valve, and the circumference of the ink bag is held between the container body unit and cover unit, ensuring as constant a shape as possible and preventing pressure changes caused by oscillation.

DESCRIPTION OF THE PREFERRED EMBODIMENTS

Figure 1:
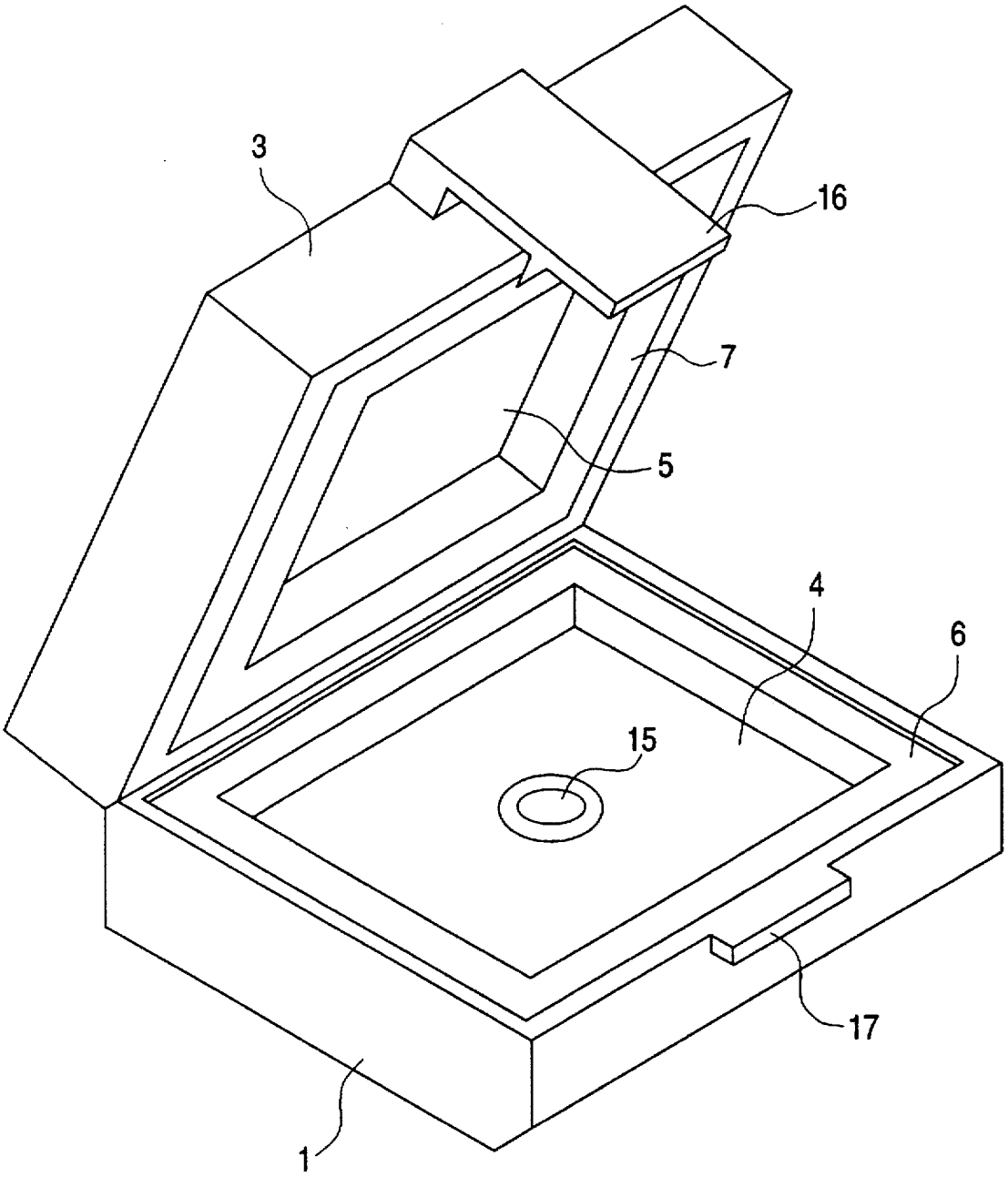
FIG. 1 is a perspective view showing one embodiment of the present invention with the cover opened, without an ink bag.

Now, the details of the present invention are explained below based on an embodiment shown in the drawings.

Figure 2:
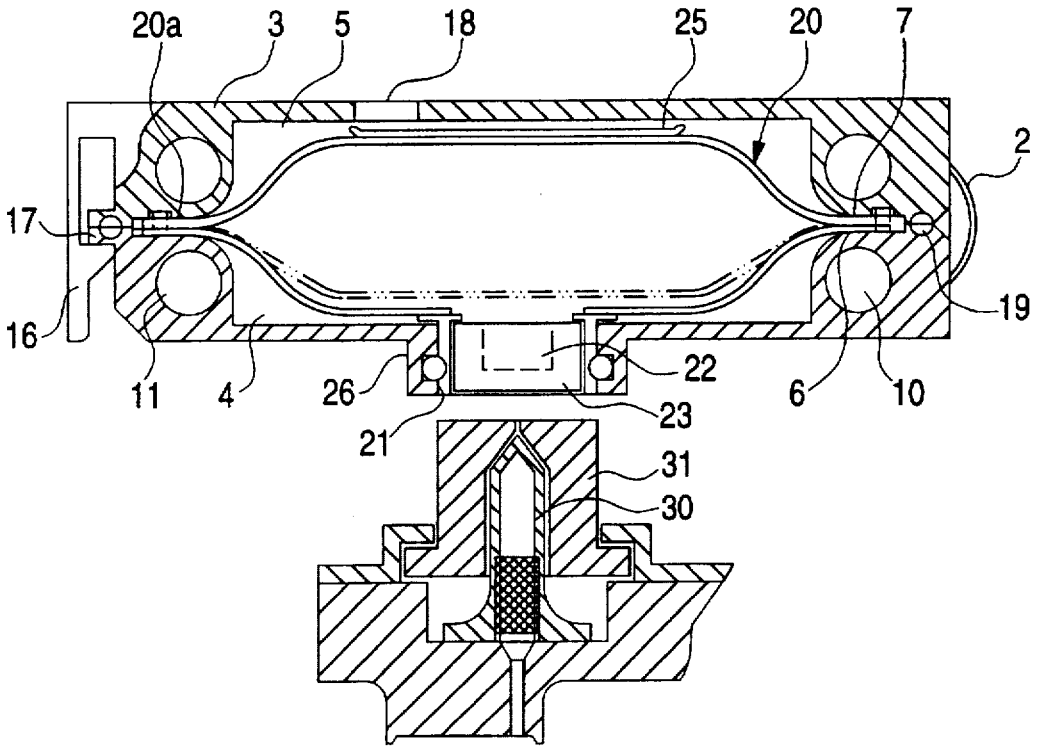
FIG. 2 is a cross-sectional view showing one embodiment of the present invention where the ink bag is present and the container is sealed.

FIGS. 1 and 2 are drawings showing an embodiment of the present invention; reference numeral 1 in the drawings is a container body unit, forming a tightly shuttable container, on one side of which a cover unit 3 constructed of a flexibly deformable material—for example a macromolecular material—is fitted so as to be capable of opening and closing by hinge 2.

In the body unit 1 and cover unit 3, recesses 4 and 5 are provided forming a space of a size sufficient that ink bag 20 is not unnecessarily compressed; furthermore, step portions 6 and 7 holding the circumference 20*a* of the ink bag are formed in the periphery.

Figure 3:
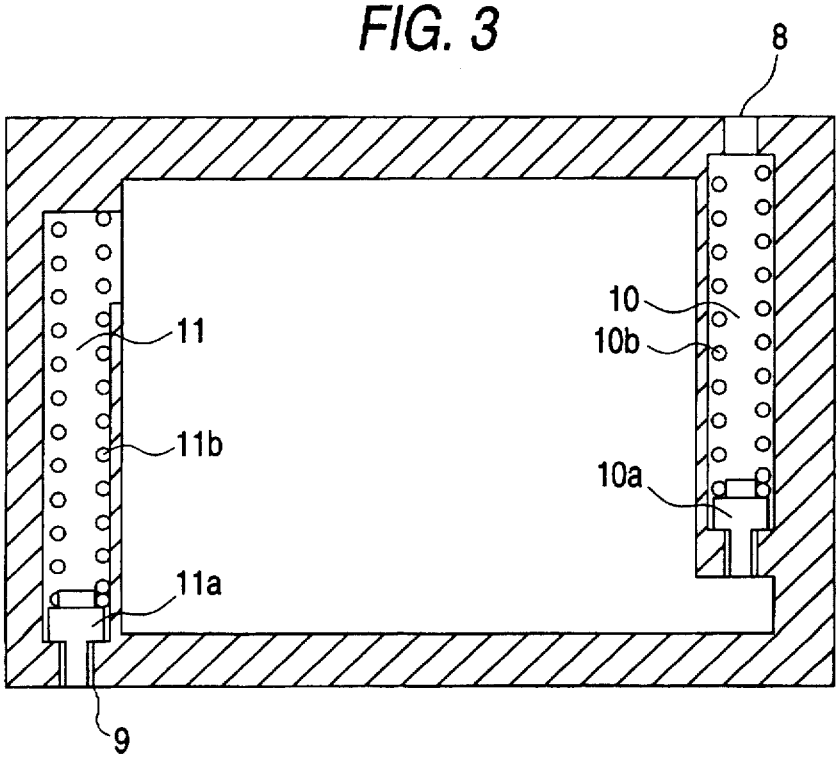
FIG. 3 is a figure showing one embodiment of valves provided with atmospheric openings.

In either body unit 1 or cover unit 3 (in this embodiment in body unit 1), as shown in FIG. 3, 2 atmospheric openings 8 and 9 communicating with recess 4 are provided, and positive pressure release valve 10 and negative pressure release valve 11 are provided respectively in these.

The construction is such that positive pressure release valve 10 opens valve plug 10*a* when the container internal pressure becomes higher than the atmospheric pressure due to a temperature rise etc.; furthermore, at a time when the pressure within the container falls to less than the pressure for optimum operational stability of the recording head—normally at a pressure level of between minus 20 and minus 30 mm-negative pressure release valve 11 opens valve plug 11*a*; each pressure release valve being compressed by springs 10*b* and 11*b* respectively.

A through hole 15 is provided in the bottom portion of the container body unit 1, matching the shape of cap 21 of ink bag 20, in the periphery of which a fixing member 26 is provided in order to lock ink cap 21 in body unit 1.

Moreover, reference numerals 16 and 17 in the drawings are, respectively, a hook member provided in cover unit 3 and a projection from body unit 1 to be connected with the hook member; further, 18 is a window for checking the interior portion constructed from a transparent material; still further, 19 is a seal member such as an O-ring.

Next, the ink bag will be explained.

It has a construction wherein the periphery of a lamination film (which has lost its air permeability) vaporized to a surface of a metal such as aluminum, is heat-welded; in the other surface, ink discharge port forming member 22—which engages ink supply needle 30 and which also has the role of an ink filling port—is fitted, surrounded peripherally by gel elastic member 23; and furthermore in the outer periphery, cap 21 is provided. Yet further, a high-rigidity plate member 25 is fixed on the top surface of the ink bag 20.

In this embodiment, in the state wherein cover unit 3 is opened and cap 21 is inserted through through hole 15, ink bag 20 is mounted in the recess portion 4 of container body unit 1 and cap 21 is fixed in container body unit 1 by fixing member 26.

When cover unit 3 is closed and units 1 and 3 are locked by hook member 17, it is maintained in a tightly shut condition by means of seal member 19. In this state, when cover unit 3 is compressed in a slightly concave fashion, the container internal pressure will increase, positive pressure release valve 10 opens and air is discharged. Next, when you take your hand off, because the cover returns to its original state by its own elasticity, the inside of the container is a little de-pressurized.

Figure 4A:
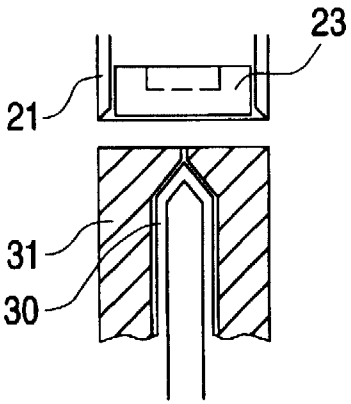
FIGS. 4A, 4B, 4C and 4D are figures each showing the operation of the valve when the cartridge is fitted onto the ink supply needle of a recording head provided on a carriage.
Figure 4B:
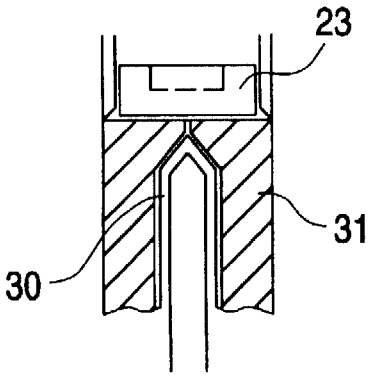

The cartridge is mounted onto the carriage in this condition, and cap 21 opposes ink supply needle 30 as shown in FIG. 4A. Therefore, because both the upper end of gel member 31 covering ink supply needle 30 and the lower end of gel member 23 in cap 21 are finished in a flat plane, they abut while removing air which exists between both sides as shown in FIG. 4B.

Figure 4C:
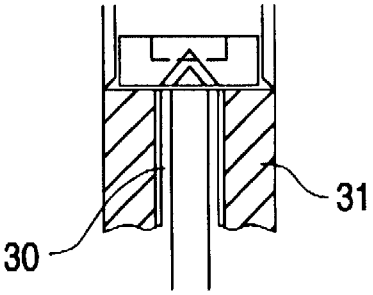
Figure 4D:
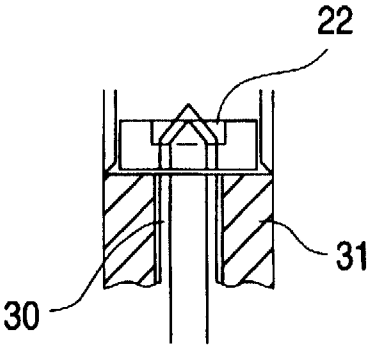

When the container is pushed in this condition, the gel member 31 covering the outer periphery of ink supply needle 30 descends while elastically deforming, exposing ink supply needle 30 which it covers as shown in FIG. 4C; furthermore, due to this pushing, ink supply needle 30 penetrates gel member 23 and engages with ink discharge port forming member 22 as shown in FIG. 4D.

Because ink supply needle 30 is inserted into ink bag 20 in this condition with as much air as possible removed, it is possible to prevent the intrusion of air into ink bag 20. Moreover, during insertion into the carriage, because gel member 23 and gel member 31 maintain an airtight state through their mutual adhesion, the intrusion of air into ink bag 20 is prevented and furthermore, it is useful for ink leakage prevention.

Printing is performed in this state and, although the ink inside ink bag 20 tends to oscillate due to the movement of the carriage, the periphery of the ink bag is tensed by container body unit 1 and cover unit 3 ensuring as constant a shape as possible; and, because the top surface plate member 25 contacts cover unit 3, oscillation is prevented and consequently, it is possible to prevent changes in ink pressure.

As the capacity of ink bag 20 becomes smaller when ink is consumed by printing and the ink in ink bag 20 becomes less, the pressure of the inside of the container drops. When the pressure level of ink bag 20, that is the pressure within the container, falls to less than the pressure level at which the operation of the recording head is stable, negative pressure release valve 11 opens and there is communication between the inside of the container and the atmosphere. Consequently, air flows into the internal portion of the container, and at the point where the negative pressure has decreased to the optimum negative pressure level, negative pressure release valve 11 closes, and this negative pressure is henceforth maintained.

What is more, in the case where the environmental temperature increases and the pressure of the container internal portion becomes higher than the atmospheric pressure, positive pressure release valve 10 opens, the internal portion air is released, and the pressure of the container internal portion drops to the level of atmospheric pressure.

These actions are repeated until the ink runs out.

At the stage where ink has been consumed and has run out; when the container is detached from the carriage, the elastically deformed gel member 31 returns to its original condition and covers the ink supply needle, preventing the evaporation of ink within the recording head. At the same time, because gel member 23 covering ink discharge port forming member 22 also returns to its original condition, leakage of the small amount of ink remaining in the ink bag is prevented.

Next, the fixing to the container body unit is released, the cover unit is opened and ink bag 20 is removed; and a new ink bag is replaced in the same way as in the process described above.

Figure 5:
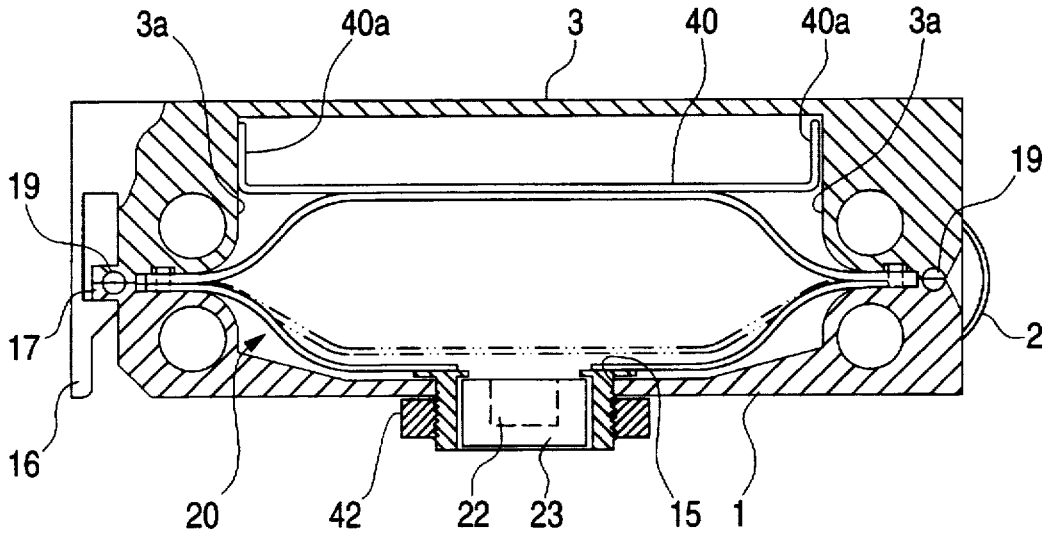
FIG. 5 is a cross-sectional view showing another embodiment of the present invention.

FIG. 5 is a drawing showing a second embodiment of the present invention. In this embodiment plate member 25 in the previously-described embodiment is constructed as a dish 40, and its peripheral wall 40*a* is made to contact the sidewall 3*a* of cover unit 3. Additionally, reference number 42 in the drawing is a fixing device provided in the periphery of through hole 15; in this embodiment, a twist-lock fixing method is utilized.

In the present embodiment, in the upper surface of dish 40 a gel or such like vibration absorption member is accommodated up to a height at which that upper surface abuts cover unit 3, and the surface of that gel member adheres to the inner surface of cover unit 3 by means of its own inherent adhesivity.

In this condition, printing is carried out and, due to movement of the carriage, the ink within ink bag 20 tends to oscillate, but the periphery of ink bag 20 is held by container body unit 1 and cover unit 3 and it is maintained in as constant a shape as possible, and as the side walls 40*a* of the upper surface dish unit 40 contact the side walls 3*a* of cover unit 3, oscillation is prevented. Furthermore, vibration of ink within the inner portion is also absorbed by the gel member inside dish unit 40.

Figure 6A:
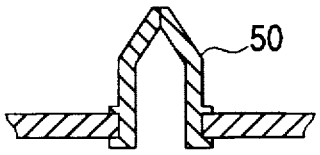
FIGS. 6A, 6B and 6C are figures each showing another embodiment of valves provided in the atmospheric openings.
Figure 6B:
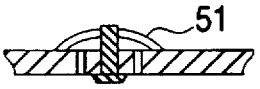
Figure 6C:
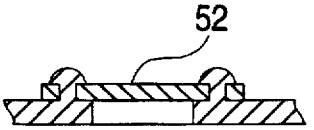

Furthermore, the above-described embodiment uses valves in which the operating pressure is settable by means of a spring, but use of a duck bill valve 50 such as that shown in FIG. 6A, and check valves 51, 52 such as those shown in FIGS. 6B and 6C is possible. Although the drawings indicate that many of the parts are made of metal, some of these parts may be formed of plastic, or any other material capable of performing its function.

What is claimed is:

1. An ink cartridge for ink supply to an ink jet recording head in an ink jet printer, comprising:

a container having a body unit and a cover unit to form an internal space therebetween, at least one of said body unit and said cover unit being provided with valves openable for communication between the internal space of said container and the atmosphere according to pressure change in said container;

an ink bag containing ink therein, said ink bag being mounted in the internal space of said container;

a connecting member provided in said container for allowing fluid communication between the ink in said ink bag and said ink jet recording head; and a plate member, said plate member being made from a rigid member and being provided on a top surface of said ink bag.

2. The ink cartridge of claim 1, wherein said cover unit is formed of a flexibly deformable material.

3. The ink cartridge of claim 1, wherein the periphery of said ink bag is held by said body unit and said cover unit.

4. The ink cartridge of claim 1, further including an oscillation absorbing member provided on said plate member in such a way as to contact the inner surface of said container.

5. The ink cartridge of claim 1, wherein said plate member has side walls in contact with the inner surface of said container.

6. The ink cartridge of claim 1, wherein said valves include a first valve which opens when a pressure within said container is less than the predetermined pressure level, and a second valve which opens when a pressure within said container is greater than the atmospheric pressure.

7. The ink cartridge of claim 1, wherein said ink bag is provided with an ink discharge port forming member having a through hole, and said connecting member includes a gel elastic member covering said ink discharge port forming member.

8. The ink cartridge of claim 1, wherein said ink bag is detachably mounted in said container.

9. The ink cartridge of claim 1, wherein said cover unit of said container is flexibly deformable to initially place said container under negative atmospheric pressure.

10. The ink cartridge of claim 1, wherein said ink bag is held by said body unit and said cover unit of said container.

11. An ink jet printer comprising:

an ink jet recording head mounted on a carriage;

an ink cartridge mountable onto said ink jet recording head for the delivery of ink thereto, said ink cartridge including:

a container having a body unit and a cover unit to form an internal space therebetween, at least one of said body unit and said cover unit being provided with valves openable for communication between the internal space of said container and the atmosphere according to pressure change in said container;

an ink bag containing ink therein, said ink bag being mounted in the internal space of said container;

a connecting member provided in said container for allowing fluid communication between the ink in said ink bag and said ink jet recording head; and an ink discharge port forming member in said ink bag having a through hole, said connecting member including a gel elastic member covering said ink discharge port forming member.

12. The ink jet printer of claim 11, wherein said ink jet recording head is formed with an ink supply needle covered with a gel member, said gel member of said ink jet recording head abutting said gel elastic member covering said ink discharge port forming member before said ink supply needle is inserted into said ink discharge port forming member.

13. The ink cartridge of claim 11, wherein said ink bag is detachably mounted in said container.

14. The ink cartridge of claim 11, wherein said cover unit of said container is flexibly deformable so that said container is initially under negative atmospheric pressure.

15. The ink cartridge of claim 11, wherein said ink bag is held by said body unit and said cover unit of said container.

16. An ink cartridge for ink supply to an ink jet recording head in an ink jet printer, comprising:

a container having a body unit and a cover unit to form an internal space therebetween, at least one of said body unit and said cover unit being provided with valves openable for communication between the internal space of said container and the atmosphere according to pressure change in said container;

an ink bag containing ink therein, said ink bag being mounted in the internal space of said container and said ink bag being provided with an ink discharge port forming member having a through hole; and a connecting member provided in said container for allowing fluid communication between the ink in said ink bag and said ink jet recording head; said connecting member including a gel elastic member covering said ink discharge port forming member.

17. The ink cartridge of claim 16, wherein said cover unit is formed of a flexibly deformable material.

18. The ink cartridge of claim 16, wherein the periphery of said ink bag is held by said body unit and said cover unit.

19. The ink cartridge of claim 16, wherein a plate member made from a rigid member is provided on a top surface of said ink bag.

20. The ink cartridge of claim 19, further including an oscillation absorbing member provided on said plate member in such a way as to contact the inner surface of said container.

21. The ink cartridge of claim 19, wherein said plate member has side walls in contact with the inner surface of said container.

22. The ink cartridge of claim 16, wherein said valves include a first valve which opens when a pressure within said container is less than the predetermined level, and a second valve which opens when a pressure within said container is greater than the atmospheric pressure.

* * * * *